US007146762B1

(12) United States Patent
Leung

(10) Patent No.: US 7,146,762 B1
(45) Date of Patent: Dec. 12, 2006

(54) CLOSE COMBAT BUTT STOCK WITH BLADE FOR ASSAULT RIFLES

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 332 days.

(21) Appl. No.: 10/925,336

(22) Filed: Aug. 24, 2004

(51) Int. Cl.
*F41C 27/16* (2006.01)

(52) U.S. Cl. ..... 42/86; 42/71.01

(58) Field of Classification Search ..... 42/86, 42/71.01–74
See application file for complete search history.

(56) References Cited

U.S. PATENT DOCUMENTS

| | | | | |
|---|---|---|---|---|
| 51,690 | A | 12/1865 | Bunsen | |
| 546,344 | A * | 9/1895 | Prass | 42/71.01 |
| 1,290,807 | A * | 1/1919 | Tomanek | 42/86 |
| 1,314,672 | A | 9/1919 | Kozlowski | |
| 1,359,425 | A * | 11/1920 | Emilio | 89/1.3 |
| 1,504,073 | A * | 8/1924 | Moore | 30/162 |
| 1,532,960 | A * | 4/1925 | Tomanek | 42/86 |
| 1,553,985 | A * | 9/1925 | Ciesnierski | 42/86 |
| 2,330,637 | A * | 9/1943 | Spagnolo | 42/86 |
| 6,807,763 | B1 * | 10/2004 | Leung | 42/71.01 |
| 2004/0079017 | A1 * | 4/2004 | Harris | 42/86 |

* cited by examiner

*Primary Examiner*—Troy Chambers
(74) *Attorney, Agent, or Firm*—Michael Zelenka; George B. Tereschuk

(57) ABSTRACT

A close quarter combat butt stock and blade apparatus for an assault weapon is provided with a slideable cover for a close quarters combat assembly having a rear bayonet. The close quarters combat assembly is connected to the concealed rear bayonet, has an interior opening that defines a close combat handle and a hand shield and is positioned behind the first pistol grip and first trigger. A second trigger is also built into the interior opening. In a closed position, the slideable cover covers the close quarters combat assembly and the rear bayonet remains concealed within the butt stock. When the slideable cover is in the open position, the rear bayonet is simultaneously extended rearward permitting the military and law enforcement user to thrust the rear bayonet at an opponent attacking from the rear or side. Maintaining the bayonet and close quarters combat position with the firing hand next to the second trigger permits the user to fire the weapon much more quickly than before, which will optimize the handling of the assault weapon during bayonet and close quarters fighting, protect the firing hand during bayonet and close quarters fighting and provide the user the means to fire the weapon during bayonet and close quarters fighting. Other embodiments include an assault weapon, an assault rifle, an assault weapon equipped with a close quarters combat assembly and a method for rapidly sliding a slideable cover of an assault weapon and extending a rear bayonet behind a user.

56 Claims, 3 Drawing Sheets

CLOSE COMBAT BUTT STOCK WITH BLADE FOR ASSAULT RIFLES

GOVERNMENT INTEREST

The invention described herein may be manufactured, used, imported, sold, and licensed by or for the Government of the United States of America without the payment to me of any royalty thereon.

RELATED APPLICATIONS

This patent application is related to U.S. patent application Ser. No. 10/719,853 entitled "Close Combat Butt Stock For Assault Weapons" filed by the inventor herein on Nov. 21, 2003. A Notice Of Allowability has been filed in that case. This patent application is also related to U.S. patent application entitled "Close Combat Handguard For Rifles" which has been filed by the inventor herein, has not yet been assigned a Ser. No. 10/925,296.

FIELD OF THE INVENTION

The invention generally relates to the field of firearms and assault weapons. In particular, the invention relates to apparatus and methods to provide assault weapons with a close combat butt stock and blade apparatus having a rear bayonet blade for increased protection and safety of military and law enforcement users during bayonet and close combat operations.

BACKGROUND OF THE INVENTION

Most current assault weapons, including assault rifles, are designed for the military and law enforcement users to quickly raise the weapon from a carrying position to a shouldered firing position in a single motion. Military and law enforcement users still face a number of lethal close quarters combat situations during which the assault weapon will be held in a different position that is known as the bayonet and close quarters combat position wherein the assault weapon is held across the chest and not shouldered. The bayonet and close quarters combat position is suitable for those situations when an opponent or intruder is directly in front of the user and the conventional front bayonet points in front of the assault weapon near the target and no significant movement is needed to move the conventional front bayonet to the opponent. However, when the user is in an equally lethal close combat or ambush situation with a rear or sideways opponent, the user holding the assault weapon across the chest will be unable to use the conventional front bayonet without rapidly moving the entire assault weapon from the front to the rear or side positions. Using a conventional assault weapon will permit the user to move the assault weapon butt stock rearward or sideways in order to club or bludgeon the opponent to the rear or side, but that maneuver would only be painful but not lethal to the opponent. Thus, there has been a long-standing need for the military and law enforcement user holding a weapon in the standard bayonet and close quarters combat position to rapidly position a bayonet behind or beside the user. In these encounters, using the conventional front bayonet may be inadequate, cumbersome and time-consuming.

FIG. 1 illustrates a prior art assault weapon 10 in the carrying position. The prior art assault weapon 10 is equipped with conventional butt stock 11, pistol grip 12, trigger 13 and front bayonet 14. In the carrying position, the user's firing hand holds the pistol grip 12 with the index finger on the trigger 13 in preparation for firing a response to a sudden and unexpected attack or ambush where the user must rapidly switch from the carrying position to the shouldered firing position. Arrow 15 represents the upward movement from the carrying position to the shouldered firing position.

Referring now to FIG. 2, where the same numerals are employed for like structures, the military user is depicted holding the prior art assault weapon 10 in the bayonet and close quarters combat position, with a conventional front bayonet pointing directly in front of the user. If the user is initially holding the weapon 10 in the close quarters combat position across the user's body and must then fire the weapon 10 quickly because of a sudden enemy attack or ambush, the user must rapidly reposition his firing hand from the conventional butt stock 11 to the pistol grip 12 and trigger 13.

FIGS. 1 and 2 clearly illustrate the problems, shortcomings and deficiencies of the prior art assault weapon with a front bayonet by showing that the military or law enforcement user holding the assault weapon across the chest in the bayonet and close quarters combat position is unable to effectively use the front bayonet against an opponent situated behind, or next to, the user without moving the entire assault weapon toward the opponent in order to point the front bayonet at the opponent. Loss of life or injury in tactical situations can easily result from the user failing to quickly move the front bayonet against an ambushing opponent or intruder. Up until now, a user holding the prior art assault weapon 10 in the close quarters combat position with a conventional front bayonet faces certain obstacles in fighting an opponent behind the user with a front bayonet during an ambush or close quarters fighting. Other problems, shortcomings and deficiencies arising from holding the prior art assault weapon 10 in the bayonet and close quarters combat carrying position include time lost in moving the firing hand from the prior art butt stock to the pistol grip 12 and trigger 13, as well as potential injury to the knuckles and hands that are left exposed and unprotected.

Thus there has been a long-felt need for an assault weapon with a butt stock allowing the user to simultaneously hold the weapon in the bayonet and close quarters combat position, keep the firing hand ready to pull the trigger and possess the capability to rapidly extend a bayonet behind the user without the cumbersome, time-consuming and dangerous movement of the upper body, legs and entire assault weapon around to point the bayonet at the opponent or intruder. The present invention fulfills this long-felt need with a close combat butt stock and blade apparatus for assault weapons that solves the long-standing problems, shortcomings and deficiencies of prior art weapons by providing a rear bayonet in the butt stock that is hidden by a slideable cover, with the rear bayonet being readily extendable by sliding the slideable cover. The present invention further comprises a close quarters combat assembly comprising a rear bayonet, a close combat carrying handle, a second trigger and a hand shield built into the assault weapon butt stock, allowing the user to much more efficiently slide the cover back and expose the rear bayonet, as well as holding the weapon's butt stock with a firing hand much closer to a second trigger allowing the user to fire the weapon much more quickly than before, without suffering from the problems, shortcomings and deficiencies of prior art assault weapons.

SUMMARY OF THE INVENTION

It is an object of the present invention to provide a close quarters combat butt stock and blade apparatus for assault weapons with a slideable cover and rear bayonet.

It is another object of the present invention to provide a close quarters combat butt stock and blade apparatus for assault weapons with a close quarters combat assembly further comprising a slideable cover, a rear bayonet, a close combat handle, a second trigger and a hand shield.

It is a further object of the present invention to provide methods for rapidly removing a slideable cover and extending a rear bayonet behind or to the side of the military or law enforcement user.

These and other objects and advantages can now be attained by this invention's close quarters combat butt stock and blade apparatus for assault weapons, comprising a slideable cover for a close quarters combat assembly further comprising a rear bayonet, a close combat carrying handle, a second trigger and hand shield. In accordance with the present invention, the military and law enforcement user can now safely and efficiently hold the assault weapon in the bayonet and close quarters combat position with the firing hand in close proximity to the slideable cover and then simultaneously and rapidly slide the slideable cover and extend the rear bayonet with a single motion of the firing hand. Maintaining the bayonet and close quarters combat position with the firing hand next to the slideable cover permits the user to rapidly slide the slideable cover back and then extend a rear bayonet behind the user toward a rear opponent much more quickly than moving the front bayonet and the entire assault weapon around from the front to the rear, without suffering from the problems, shortcomings and deficiencies of prior art assault weapons. The close quarters combat assembly of the present invention also includes a second trigger and a hand shield for added user protection and versatility. By incorporating this invention's close combat butt stock and blade apparatus into current military and law enforcement arsenals, these weapons will now optimize bayonet use and other handling of the weapon during bayonet and close quarters fighting, protect the user from an ambush or sudden attack by allowing a rearwards bayonet thrust, protect the firing hand during bayonet and close quarters fighting and provide the user the means to fire the weapon with the second trigger during bayonet and close quarters fighting, without suffering from the problems, disadvantages and shortcomings of prior art assault weapons. Other embodiments include an assault weapon, an assault rifle, an assault weapon equipped with a close combat butt stock assembly and a method for rapidly removing a slideable cover and extending a rear bayonet behind the user, which are also considered to be within the contemplation of the present invention.

DETAILED DESCRIPTION OF THE DRAWINGS

Figure 1:
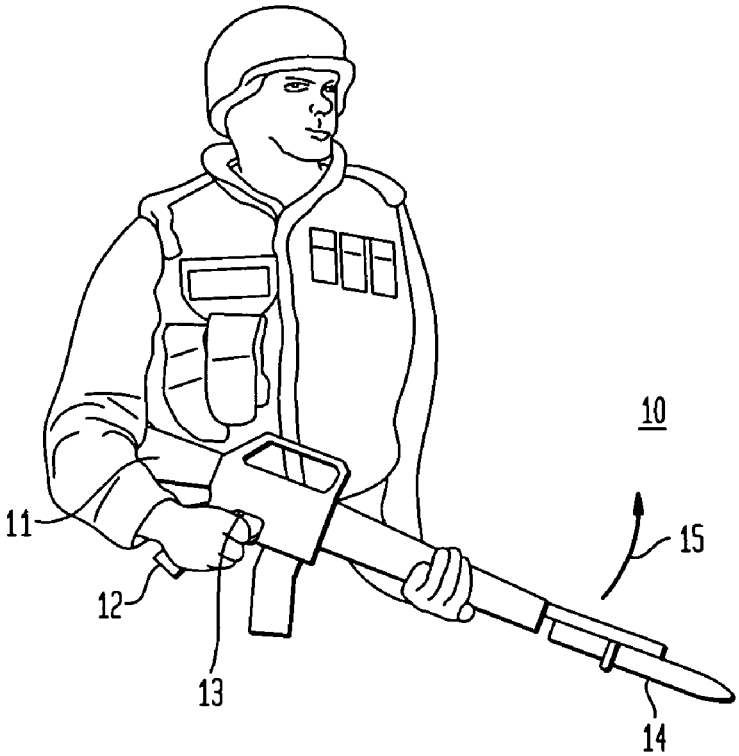
FIG. 1 (PRIOR ART)
FIG. 1 depicts a prior art assault weapon in the carrying position.
Figure 2:
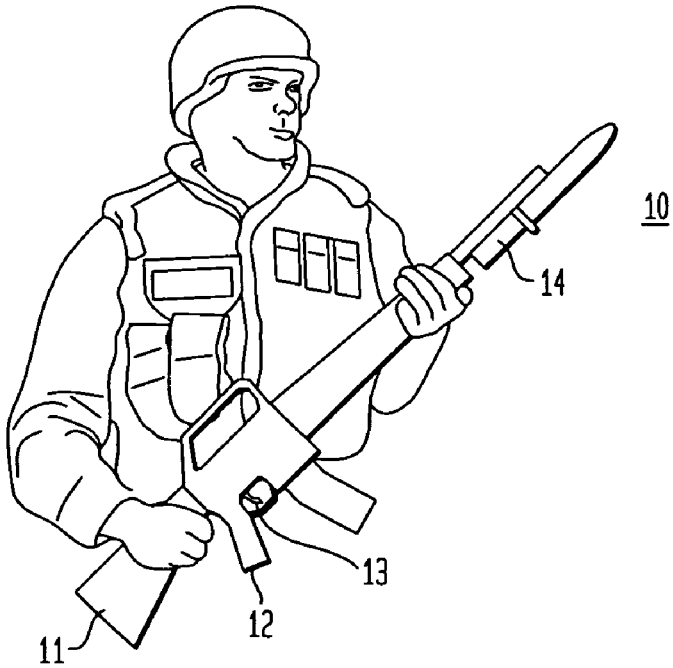
FIG. 2 (PRIOR ART)
FIG. 2 depicts a prior art assault weapon in the bayonet and close combat position.

FIGS. 1 and 2 depict the standard carrying and bayonet and close quarters combat positions with a conventional prior art weapon equipped with a front bayonet. FIGS. 1 and 2 also illustrate the problems, shortcomings and deficiencies of prior art assault weapons with a conventional butt stock and the long-standing need for the military and law enforcement user to rapidly position a bayonet point backwards or sideways in lethal close combat or ambush situations where the opponent is not directly in front of the user. Whenever military and law enforcement users were required to hold the weapon in the bayonet and close quarters combat position, the prior art limits the user to only using the front bayonet when an opponent is directly in front of the user and requires the user to reposition the entire assault weapon 10 to use the front bayonet 14 against an opponent who attacks from the rear or side. FIG. 2 also illustrates that the firing hand is positioned on the conventional butt stock 11 and several inches away from the pistol handle 12 and trigger 13. In accordance with the close combat butt stock and blade apparatus of the present invention, the military and law enforcement user can now simultaneously slide the slideable butt stock cover and rear bayonet back permitting the user to now confront an opponent attacking from the back and the sides with the firing hand in close proximity to the slideable cover.

Figure 3A:
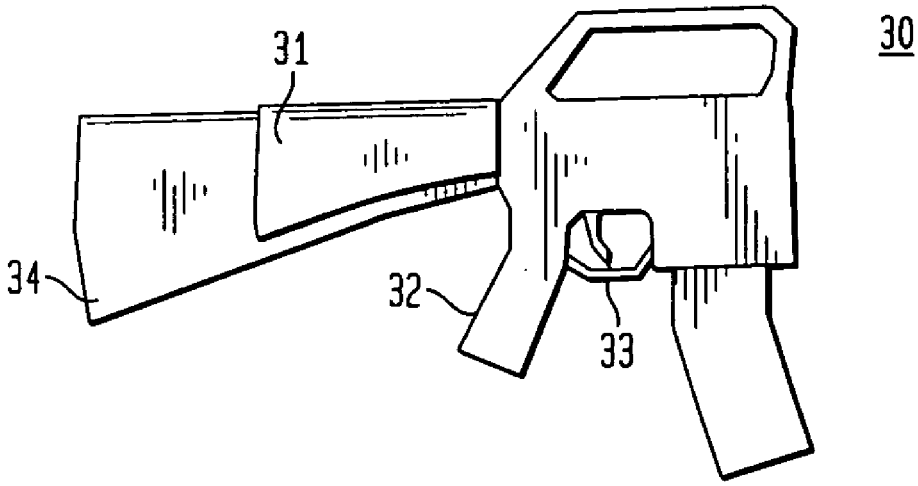
FIGS. 3A–3B are side views of the close combat butt stock and blade apparatus of the present invention illustrating the close quarters combat assembly in the covered and open positions.

Referring now to FIG. 3A, there is depicted an assault weapon 30 and the close combat butt stock and blade apparatus of the present invention with the close quarters combat assembly 34 in the covered position. Assault weapon 30 further comprises a first pistol grip 22, a first trigger 23 and a slideable cover 31 that covers the close quarters combat assembly 34. The close quarters combat assembly 34 is located in the vicinity of the first pistol grip 22 and first trigger 23. When the close quarters combat assembly 34 is in the covered position the assault weapon 30 appears quite similar to the conventional butt stock 11 depicted in FIGS. 1 and 2.

Figure 3B:
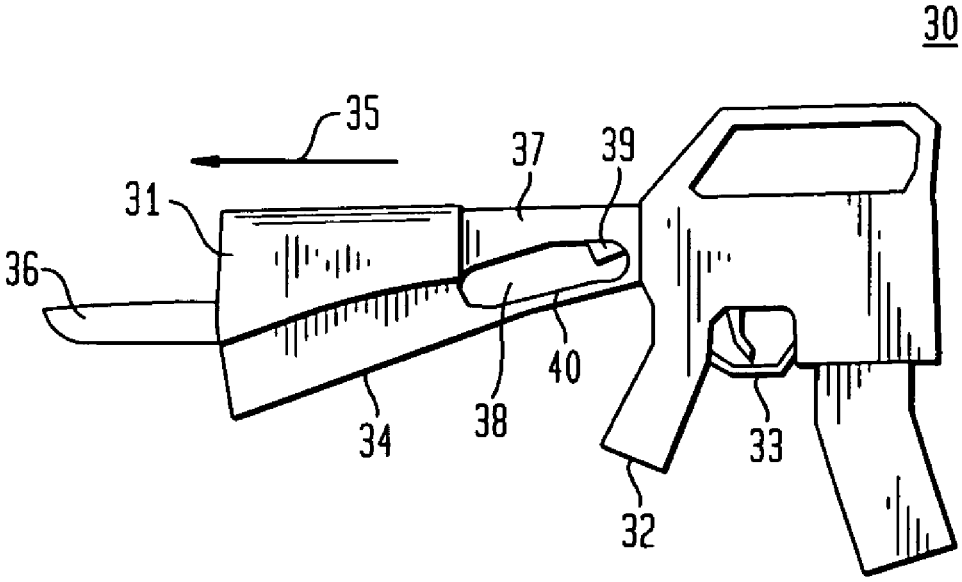

Referring now to FIG. 3B, where the same numerals are employed for like structures, assault weapon 30 is depicted with the slideable cover 31 in the open position and fully extended away from the first pistol grip 32, as indicated by arrow 35. When the firing hand is in close proximity to the slideable cover 31, a single motion of the firing hand can rapidly slide the slideable cover 31 backwards and extend the rear bayonet 36 behind the user toward an opponent or intruder much more quickly than moving the front bayonet and the entire assault weapon 30 around from the front to the rear. Sliding the slideable cover 31 back also exposes a close combat handle 37, an interior opening 38, a second trigger 39 and a hand shield 40. The slideable cover 31 and rear bayonet 36 are configured so that the rear bayonet 36 is automatically and simultaneously extended back whenever the slideable cover 31 is slid back. A means for locking the slideable cover, not shown, locks the slideable cover 31 over the close quarters combat assembly and a means for trigger control can control the first trigger 33 and second trigger 39.

Figure 4:
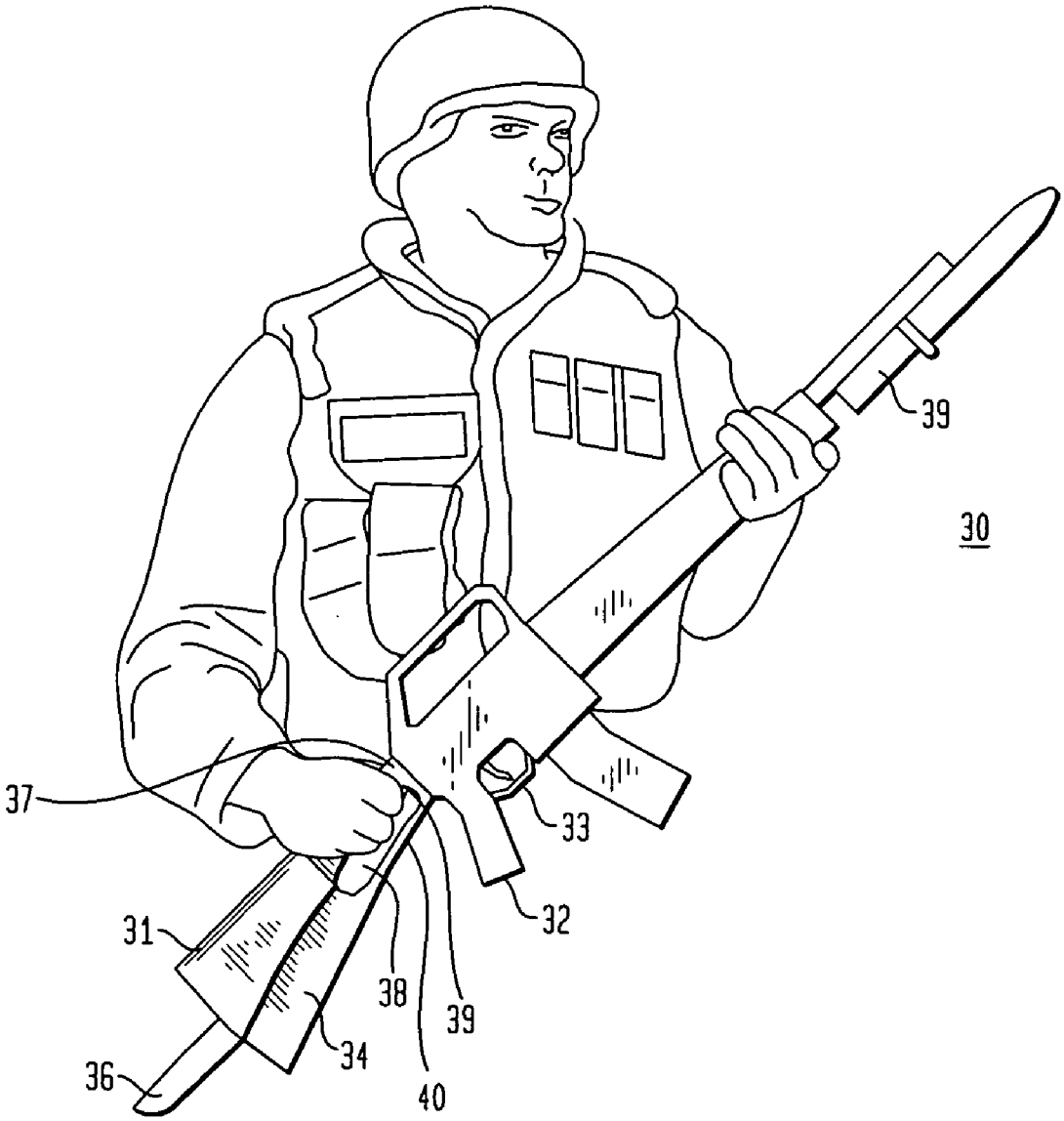
FIG. 4 depicts the close combat butt stock and blade apparatus with rear bayonet extended on an assault weapon in accordance present invention.

FIG. 4 depicts the military user holding the assault weapon 30 in the bayonet and close quarters combat position and the slideable cover 31 in the open position with the firing hand holding the close combat handle 37. In accordance with the close combat butt stock and blade apparatus of the present invention, the military and law enforcement user can now rapidly swing and thrust the assault weapon 30 with the rear bayonet 36 extended back much more naturally and quickly in order to confront an opponent ambushing the user from the rear or sides. With the slideable cover 31 in the open position, the firing hand can either hold the close combat handle 37 or also pull the second trigger 39 to fire the assault weapon and protect the knuckles of the firing hand with the hand shield 40 during close quarters fighting.

A number of variations to the close combat butt stock and blade apparatus are within the contemplation of this invention, including positioning the close combat butt assembly in the vicinity of the first pistol grip 32, locating the second trigger 39 within the interior opening 38, the user rapidly engaging the second trigger 39 with the firing hand while holding the assault weapon 30 in a bayonet and close quarters combat position and having the interior opening 38 dimensioned sufficiently large for the firing hand to rapidly grasp the close combat handle 40. The slideable cover 31 may have a means for locking the slideable cover and, during the covered position, the slideable cover 31 covers the close combat butt assembly when not in use and protects the close combat butt stock assembly when the assault weapon is held in other positions. The assault weapon can also be an assault rifle. Other embodiments of the present invention include an assault weapon, an assault rifle and an assault weapon equipped with a close quarters combat assembly, along with variations thereto that are similar to the close combat butt stock and blade apparatus.

The present invention also contemplates a method for rapidly sliding a slideable cover of an assault weapon and extending a rear bayonet behind a user, comprising the steps of forming a close quarters combat assembly, forming the rear bayonet, positioning the close quarters combat assembly within a butt stock of the assault weapon, configuring the close quarters combat assembly with the slideable cover being connected to the rear bayonet and forming the slideable cover to have an open position and a closed position. In a positioning step, the close quarters combat assembly is positioned in the vicinity of a first pistol grip and in an opposite direction from a gun barrel and a first trigger of the assault weapon. During a concealing step, the rear bayonet is concealed within the butt stock when the slideable cover is in the closed position. In a sliding step, the slideable cover is rapidly slid in the opposite direction into the open position, which simultaneously extends the rear bayonet rearwards permitting the user to forcefully thrust the rear bayonet at an opponent. Many of the variations that are possible with the other embodiments of the present invention are also considered to be within the contemplation of the method of the present invention.

It is to be further understood that other features and modifications to the foregoing detailed description are encompassed by the present invention, which is not limited by this detailed description. Those skilled in the art will readily appreciate that any number of configurations and numerous modifications and combinations of materials, components, geometrical arrangements and dimensions can achieve the results described herein, without departing from the spirit and scope of this invention. Accordingly, the present invention should not be limited by the foregoing description, but only by the appended claims.

What I claim is:

1. A close combat butt stock and blade apparatus for an assault weapon, comprising:

a close quarters combat assembly, having a rear bayonet, is placed within a butt stock of said assault weapon;

said close quarters combat assembly being covered by a slideable cover connected to said rear bayonet;

said rear bayonet being concealed within said butt stock when said slideable cover is in a closed position; and said slideable cover slides rapidly in said opposite direction into said open position simultaneously extending said rear bayonet rearwards permitting said user to forcefully thrust said rear bayonet at an opponent.

2. The close combat butt stock and blade apparatus for the assault weapon, as recited in claim 1, further comprising said close quarters combat assembly being positioned in the vicinity of said first pistol grip and a first trigger.

3. The close combat butt stock and blade apparatus for the assault weapon, as recited in claim 2, further comprising said slideable cover being slid backwards in said open position.

4. The close combat butt stock and blade apparatus for the assault weapon, as recited in claim 3, further comprising:

said close quarters combat assembly having an interior opening;

a second trigger is positioned within said interior opening; and said interior opening defines a close combat handle and a hand shield.

5. The close combat butt stock and blade apparatus for the assault weapon, as recited in claim 4, further comprising said interior opening being dimensioned sufficiently large for a firing hand to rapidly grasp said close combat handle.

6. The close combat butt stock and blade apparatus for the assault weapon, as recited in claim 5, further comprising said close quarters combat assembly permitting said user to grasp said close combat handle with said firing hand when forcefully thrusting said rear bayonet.

7. The close combat butt stock and blade apparatus for the assault weapon, as recited in claim 6, further comprising said user rapidly engaging said second trigger with said firing hand while holding said assault weapon in a bayonet and close quarters combat position diagonally across said user's body.

8. The close combat butt stock and blade apparatus for the assault weapon, as recited in claim 7, further comprising a means for locking said slideable cover.

9. The close combat butt stock and blade apparatus for the assault weapon, as recited in claim 8, further comprising said close quarters combat assembly being protected by said slideable cover when said user holds said assault weapon in a plurality of other positions.

10. The close combat butt stock and blade apparatus for the assault weapon, as recited in claim 9, further comprising said opponent attacking said user from a plurality of directions.

11. The close combat butt stock and blade apparatus for the assault weapon, as recited in claim 10, further comprising said assault weapon being an assault rifle.

12. The close combat butt stock and blade apparatus for the assault weapon, as recited in claim 11, further comprising a one of said plurality of directions being behind said user.

13. The close combat butt stock and blade apparatus for the assault weapon, as recited in claim 12, further comprising another one of said plurality of directions being beside said user.

14. An assault weapon, comprising:

a first trigger;

a first pistol grip;

a gun barrel;

a close quarters combat assembly, having a rear bayonet, is placed within a butt stock of said assault weapon and located in the vicinity of said first pistol grip pointing in an opposite direction from said gun barrel;

said close quarters combat assembly including an interior opening that defines a close combat handle and a hand shield, said interior opening being dimensioned sufficiently large for a user's firing hand to hold said close combat handle;

said close quarters combat assembly being covered by a slideable cover connected to said rear bayonet, said slideable cover having an open position and a closed position;

said rear bayonet being concealed within said butt stock when said slideable cover is in said closed position;

a second trigger being positioned within said interior opening; and said slideable cover slides rapidly in said opposite direction into said open position simultaneously extending said rear bayonet rearwards permitting said user to forcefully thrust said rear bayonet at an opponent.

15. The assault weapon, as recited in claim 14, further comprising said slideable cover being slid backwards.

16. The assault weapon, as recited in claim 15, further comprising said first trigger and said second trigger being controlled by a means for trigger control.

17. The assault weapon, as recited in claim 16, further comprising said close quarters combat assembly permitting said user to grasp said close combat handle with said firing hand when forcefully thrusting said rear bayonet.

18. The assault weapon, as recited in claim 17, further comprising said user rapidly engaging said second trigger with said firing hand while holding said assault weapon in a bayonet and close quarters combat position diagonally across said user's body.

19. The assault weapon, as recited in claim 18, further comprising a means for locking said slideable cover.

20. The assault weapon, as recited in claim 19, further comprising said close quarters combat assembly being protected by said slideable cover when said user holds said assault weapon in a plurality of other positions.

21. The assault weapon, as recited in claim 20, further comprising said opponent attacking said user from a plurality of directions.

22. The assault weapon, as recited in claim 21, further comprising said assault weapon being an assault rifle.

23. The assault weapon, as recited in claim 22, further comprising a one of said plurality of directions being behind said user.

24. The assault weapon, as recited in claim 23, further comprising another one of said plurality of directions being beside said user.

25. An assault rifle, comprising:

a first trigger;

a first pistol grip;

a gun barrel;

a close quarters combat assembly, having a rear bayonet, is placed within a butt stock of said assault rifle and located in the vicinity of said first pistol grip pointing in an opposite direction from said gun barrel;

said close quarters combat assembly including an interior opening that defines a close combat handle and a hand shield, said interior opening being dimensioned sufficiently large for a user's firing hand to hold said close combat handle;

said close quarters combat assembly being covered by a slideable cover connected to said rear bayonet, said slideable cover having an open position and a closed position;

said rear bayonet being concealed within said butt stock when said slideable cover is in said closed position;

a second trigger being positioned within said interior opening; and said slideable cover slides rapidly in said opposite direction into said open position simultaneously extending said rear bayonet rearwards permitting said user to forcefully thrust said rear bayonet at an opponent.

26. The assault rifle, as recited in claim 25, further comprising said slideable cover being slid backwards.

27. The assault rifle, as recited in claim 26, further comprising said first trigger and said second trigger being controlled by a means for trigger control.

28. The assault rifle, as recited in claim 27, further comprising said close quarters combat assembly permitting said user to grasp said close combat handle with said firing hand when forcefully thrusting said rear bayonet.

29. The assault rifle, as recited in claim 28, further comprising said user rapidly engaging said second trigger with said firing hand while holding said assault rifle in a bayonet and close quarters combat position diagonally across said user's body.

30. The assault rifle, as recited in claim 29, further comprising a means for locking said slideable cover.

31. The assault rifle, as recited in claim 30, further comprising said close quarters combat assembly being protected by said slideable cover when said user holds said assault rifle in a plurality of other positions.

32. The assault rifle, as recited in claim 31, further comprising said opponent attacking said user from a plurality of directions.

33. The assault rifle, as recited in claim 32, further comprising a one of said plurality of directions being behind said user.

34. The assault rifle, as recited in claim 33, further comprising another one of said plurality of directions being beside said user.

35. An assault weapon equipped with a close quarters combat assembly, comprising:

a first trigger;

a first pistol grip;

a gun barrel;

said close quarters combat assembly, having a rear bayonet, is placed within a butt stock of said assault weapon and located in the vicinity of said first pistol grip pointing in an opposite direction from said gun barrel;

said close quarters combat assembly including an interior opening that defines a close combat handle and a hand shield, said interior opening being dimensioned sufficiently large for a user's firing hand to hold said close combat handle;

said close quarters combat assembly being covered by a slideable cover connected to said rear bayonet, said slideable cover having an open position and a closed position;

said rear bayonet being concealed within said butt stock when said slideable cover is in said closed position;

a second trigger being positioned within said interior opening; and said slideable cover slides rapidly in said opposite direction into said open position simultaneously extending said rear bayonet rearwards permitting said user to forcefully thrust said rear bayonet at an opponent.

36. The assault weapon equipped with the close quarters combat assembly, as recited in claim 35, further comprising said slideable cover being slid backwards.

37. The assault weapon equipped with the close quarters combat assembly, as recited in claim 36, further comprising said first trigger and said second trigger being controlled by a means for trigger control.

38. The assault weapon equipped with the close quarters combat assembly, as recited in claim 37, further comprising said close quarters combat assembly permitting said user to grasp said close combat handle with said firing hand when forcefully thrusting said rear bayonet.

39. The assault weapon equipped with the close quarters combat assembly, as recited in claim 38, further comprising said user rapidly engaging said second trigger with said firing hand while holding said assault weapon in a bayonet and close quarters combat position diagonally across said user's body.

40. The assault weapon equipped with the close quarters combat assembly, as recited in claim 39, further comprising a means for locking said slideable cover.

41. The assault weapon equipped with the close quarters combat assembly, as recited in claim 40, further comprising said close quarters combat assembly being protected by said slideable cover when said user holds said assault weapon in a plurality of other positions.

42. The assault weapon equipped with the close quarters combat assembly, as recited in claim 41, further comprising said opponent attacking said user from a plurality of directions.

43. The assault weapon equipped with the close quarters combat assembly, as recited in claim 42, further comprising said assault weapon being an assault rifle.

44. The assault weapon equipped with the close quarters combat assembly, as recited in claim 43, further comprising a one of said plurality of directions being behind said user.

45. The assault weapon equipped with the close quarters combat assembly, as recited in claim 44, further comprising another one of said plurality of directions being beside said user.

46. A method for rapidly sliding a slideable cover of an assault weapon and extending a rear bayonet behind a user, comprising the steps of:

forming a close quarters combat assembly;

forming said rear bayonet;

positioning said close quarters combat assembly within a butt stock of said assault weapon;

configuring said close quarters combat assembly with said slideable cover connected to said rear bayonet;

forming said slideable cover to have an open position and a closed position;

positioning said close combat butt stock assembly in the vicinity of a first pistol grip and in an opposite direction from a gun barrel and a first trigger of said assault weapon;

concealing said rear bayonet being within said butt stock when said slideable cover is in said closed position; and sliding said slideable cover rapidly in said opposite direction into said open position simultaneously extending said rear bayonet rearwards permitting said user to forcefully thrust said rear bayonet at an opponent.

47. The method for rapidly sliding the slideable cover of the assault weapon and extending the rear bayonet behind the user, as recited in claim 46, further comprising the step of sliding said slideable cover backwards.

48. The method for rapidly sliding the slideable cover of the assault weapon and extending the rear bayonet behind the user, as recited in claim 47, further comprising the step of controlling said first trigger and said second trigger with a means for trigger control.

49. The method for rapidly sliding the slideable cover of the assault weapon and extending the rear bayonet behind the user, as recited in claim 48, further comprising the step of grasping said close combat handle with said firing hand when forcefully thrusting said rear bayonet.

50. The method for rapidly sliding the slideable cover of the assault weapon and extending the rear bayonet behind the user, as recited in claim 49, further comprising the step of rapidly engaging said second trigger with said firing hand while holding said assault weapon in a bayonet and close quarters combat position diagonally across said user's body.

51. The method for rapidly sliding the slideable cover of the assault weapon and extending the rear bayonet behind the user, as recited in claim 50, further comprising the step of providing a means for locking said slideable cover.

52. The method for rapidly sliding the slideable cover of the assault weapon and extending the rear bayonet behind the user, as recited in claim 51, further comprising the step of protecting said close quarters combat assembly with said slideable cover in said closed position when said user holds said assault rifle in a plurality of other positions.

53. The method for rapidly sliding the slideable cover of the assault weapon and extending the rear bayonet behind the user, as recited in claim 52, wherein said opponent attacks said user from a plurality of directions.

54. The method for rapidly sliding the slideable cover of the assault weapon and extending the rear bayonet behind the user, as recited in claim 53, wherein said assault weapon is an assault rifle.

55. The method for rapidly sliding the slideable cover of the assault weapon and extending the rear bayonet behind the user, as recited in claim 54, wherein a one of said plurality of directions is behind said user.

56. The method for rapidly sliding the slideable cover of the assault weapon and extending the rear bayonet behind the user, as recited in claim 55, wherein another one of said plurality of directions is beside said user.

* * * * *